US010236608B2

(12) United States Patent
Nagata et al.

(10) Patent No.: US 10,236,608 B2
(45) Date of Patent: Mar. 19, 2019

(54) ELECTRICAL CONNECTOR FOR CIRCUIT BOARDS

(71) Applicant: Hirose Electric Co., Ltd., Tokyo (JP)

(72) Inventors: Masakazu Nagata, Tokyo (JP); Atsushi Matsuzawa, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 15/690,072

(22) Filed: Aug. 29, 2017

(65) Prior Publication Data

US 2018/0076547 A1 Mar. 15, 2018

(30) Foreign Application Priority Data

Sep. 13, 2016 (JP) ..... 2016-178685

(51) Int. Cl.

| | |
|---|---|
| ***H01R 12/71*** | (2011.01) |
| ***H01R 13/08*** | (2006.01) |
| ***H01R 13/405*** | (2006.01) |
| ***H01R 12/91*** | (2011.01) |
| ***H01R 13/422*** | (2006.01) |
| *H01R 12/73* | (2011.01) |
| *H01R 43/26* | (2006.01) |

(52) U.S. Cl.

CPC ..... *H01R 12/716* (2013.01); *H01R 12/91* (2013.01); *H01R 13/08* (2013.01); *H01R 13/405* (2013.01); *H01R 13/4223* (2013.01); *H01R 12/737* (2013.01); *H01R 43/26* (2013.01)

(58) Field of Classification Search

CPC ... H01R 12/724; H01R 13/514; H01R 12/725
USPC ..... 439/541.5, 79, 595
See application file for complete search history.

(56) References Cited

U.S. PATENT DOCUMENTS

| | | | | |
|---|---|---|---|---|
| 5,322,447 A * | 6/1994 | Okada | H01R 12/725 | 439/541.5 |
| 6,672,899 B2 * | 1/2004 | Morita | H01R 12/725 | 439/541.5 |
| 6,997,754 B2 * | 2/2006 | Wan | H01R 13/6461 | 439/541.5 |
| 7,112,098 B2 * | 9/2006 | Matsuo | H05K 1/117 | 439/660 |
| 7,195,519 B1 * | 3/2007 | McAlonis | H01R 13/518 | 439/607.39 |

(Continued)

*Primary Examiner* — Neil Abrams
(74) *Attorney, Agent, or Firm* — Procopio, Cory, Hargreaves & Savitch LLP

(57) ABSTRACT

In an electrical connector for circuit boards or blades, a holding portion formed in a housing has, for each blade, holding grooves that hold the front portions of the blades, and at least one of the above-mentioned multiple blades is fixedly secured in place within one of the corresponding holding grooves while the rest of the blades are made movable through a small gap within the respective corresponding holding grooves. With this arrangement, the fixed blade may be used as a reference while the other blades are free to move slightly during a mating step. In addition, such blade securement may be of use of resilient latches (19) positioned at both ends of each blade (20). At engagement to a mating connector, housing portion (75) of the housing is to provide support for ends of the blades (20).

3 Claims, 7 Drawing Sheets

(56) References Cited

U.S. PATENT DOCUMENTS

| | | | | |
|---|---|---|---|---|
| 7,402,077 | B2 * | 7/2008 | Shindo | H01R 12/722 439/541.5 |
| 7,465,188 | B2 * | 12/2008 | Tan | H01R 13/518 439/541.5 |
| 7,651,371 | B2 * | 1/2010 | Yi | H01R 12/725 439/541.5 |
| 7,758,380 | B2 * | 7/2010 | Wang | H01R 27/02 439/541.5 |
| 8,182,283 | B2 * | 5/2012 | Chang | H01R 12/724 439/541.5 |
| 8,435,052 | B2 | 5/2013 | Potters | |
| 8,475,208 | B2 * | 7/2013 | Simpson | H01R 13/648 439/607.01 |
| 9,608,347 | B2 * | 3/2017 | Nagata | H01R 12/707 |
| 2006/0042829 | A1 * | 3/2006 | Matsuo | H01P 3/088 174/255 |
| 2007/0111598 | A1 * | 5/2007 | Quilici | H01R 24/60 439/595 |
| 2018/0076547 | A1 * | 3/2018 | Nagata | H01R 12/716 |

* cited by examiner

ELECTRICAL CONNECTOR FOR CIRCUIT BOARDS

CROSS REFERENCE TO RELATED APPLICATIONS

This Paris Convention Patent Application claims benefit under 35 U.S.C. § 119 and claims priority to Japanese Patent Application No. JP 2016-178685, filed on Sep. 13, 2016, titled "ELECTRICAL CONNECTOR FOR CIRCUIT BOARDS", the content of which is incorporated herein in its entirety by reference for all purposes.

BACKGROUND

Technical Field

The present invention relates to an electrical connector for circuit boards.

Background Art

There are well-known electrical connectors for circuit boards equipped with multiple terminals, in which each terminal, at one end thereof, has a portion for contacting a counterpart connector and, at the other end, a connecting portion that is soldered to a circuit board. In such connectors, the location of the connecting portions of the terminals is variable. In a free state prior to being soldered to the circuit board, the positions of the connecting portions of the multiple terminals are offset from the surface of the circuit board. However, the above-mentioned offset can be addressed when the connector is placed on the circuit board and the connecting portions are brought into contact with the surface of the circuit board.

Such electrical connectors for circuit boards include, for example, the so-called right-angle electrical connector disclosed in Patent Document 1, in which the direction of mating with a counterpart connector and the direction of the terminals relative to the circuit board are orthogonal to each other. The terminals in this Patent Document 1 are such that the direction of extension of a mating portion having a contact portion that comes into contact with the terminals of a counterpart connector and the direction of extension of a leg portion having, at its lower end, a connecting portion soldered to the circuit board are orthogonal to each other, and the mating and leg portions are coupled by an L-shaped curved portion, thereby forming a generally orthogonal configuration. The terminals that form this orthogonal configuration are fabricated as two types of terminals of different overall length. The curved portions of terminals of shorter overall length are positioned on the inside of the curved portions of terminals of longer overall length, and the mating portions and leg portions of both terminals are parallel to each other. The contact portions of both terminals are located in an opening in the front face of the housing, and the connecting portions of both terminals are located on the bottom face of the bottom wall of the housing.

The contact portions of the terminals used in Patent Document 1 integrally comprise a pair of upper and lower resilient contact pieces that clamp counterpart contact pins in the counterpart connector from above and from below, with a throat portion formed therein by protrusions shaped such that local portions of both resilient contact pieces come closer together. Into said throat portion, pre-load rails of the housing are press-fitted so as to widen the throat portion by applying pressure at two lateral locations in the width direction (direction orthogonal to the plane of the paper of FIG. 3 and FIG. 4 in Patent Document 1), which is orthogonal to the direction of insertion of the counterpart contact pins, and pre-loading in the direction of clamping of said pre-load rails is generated as a reaction force in the above-mentioned throat portion. The counterpart contact pins are inserted into the above-mentioned throat portion at a central location in the above-mentioned width direction (i.e., between the above-mentioned pre-load rails in the width direction). Since the dimensions of said counterpart contact pins in the vertical direction are larger than those of the above-mentioned pre-load rails, the throat portion is further widened and the throat portion comes into contact with the counterpart contact pins under a contact pressure that is equal to, or higher than, the above-mentioned pre-loading.

The above-mentioned throat portion is located such that the upper and lower points of contact with the pre-load rails are offset in the longitudinal direction, and the upper contact point is closer to the opening in the front face than the lower contact point. Therefore, in a state prior to the insertion of the counterpart contact pins, a spreading force produced by the pre-load rails acts as a force couple at the two contact points offset in the longitudinal direction, as a result of which the terminals are acted upon by a moment that downwardly pushes the leg portions and, in turn, the connecting portions.

According to Patent Document 1, even though the connecting portions of the two types of terminals (i.e., both the longer and shorter terminals) are in somewhat vertically misaligned positions with respect to the circuit board, the connecting portions of the two types of terminals are rendered movable by the above-mentioned moment. Accordingly, as a result of the above-mentioned moment, they apply pressure to the circuit board, thereby making it possible to align their positions with respect to the circuit board, which helps avoid solder connection defects.

PRIOR-ART CITATIONS

Patent Documents

Patent Document 1
Specification of U.S. Pat. No. 8,435,052.

SUMMARY

Problems to be Solved by the Invention

The present disclosure is directed to provide an electrical connector for circuit boards in which the connecting portions of the electrically conductive elongated members of all the blades can be placed on the corresponding circuits even if the amount of lateral movability is minimal.

In Patent Document 1, none of the connecting portions of the two types of terminals has a fixed position and each one is movable both in a heightwise direction and in a lateral direction, so that even though in a free-state they are in vertically misaligned positions with respect to the circuit board, when they are placed in a state of contact with the circuit board, the above-mentioned moment puts them in alignment on the circuit board.

However, since all the connecting portions of the two types of terminals are movable, their heightwise positions prior to being placed on the surface of the circuit board are different. When they are in contact with the surface of the circuit board, the portions are aligned in a heightwise direction orthogonal to the surface of the circuit board.

However, due to a difference in heightwise positions preexisting before both connecting portions come into contact with the above-mentioned surface of the circuit board in a lateral direction parallel to the surface of the circuit board, there is a difference between the position obtained at the instant when they touch the circuit board and the position obtained after moving in the lateral direction and stabilizing as a result of being pressed against the circuit board. Furthermore, due to the random product variation present among multiple connectors, the movability of the above-mentioned connecting portions in the heightwise direction differs from their movability in the lateral direction and, as a result, even though the portions are pressed against the circuit board to ensure identical amounts of displacement in the heightwise direction, the amounts by which their positions in the above-mentioned lateral direction differ from the normal position are different. Thus, during automated mounting of connectors to circuit boards, the positions of the connecting portions are not fixed, which creates problems.

In the connector of Patent Document 1, when an attempt is made during automated mounting to use one of the two connecting portions as a reference and place it on a corresponding circuit (pad) on the circuit board while attempting to position the other portion such that it is comprised in the corresponding circuit within the range of its lateral movability, due to the fact that the position of the above-mentioned first reference connecting portion itself is not fixed and possesses a certain amount of lateral movability, the position of the above-mentioned first connecting portion with respect to the corresponding circuit is not determined and, even if it is comprised within the corresponding circuit, it may be offset by the amount of the above-mentioned lateral movability and, therefore, the other connecting portion may end up being positioned on the corresponding circuit of this other connecting portion in a state in which the lateral movability of this first connecting portion is superposed on the lateral movability of said other connecting portion itself. Thus, the other connecting portion is not necessarily comprised within the corresponding circuit. However, for the other connecting portion to be definitely included in the corresponding circuit, the corresponding circuit must be made larger in order to permit positioning of the other connecting portion despite the superposition of the above-mentioned lateral movabilities. In such a case, if the number of terminals is increased, it is necessary to enlarge each corresponding circuit itself and, moreover, position the corresponding circuits at a predetermined distance from each other. As a result, the distance between the corresponding circuits (i.e., the spacing between the corresponding circuits) must be increased. This means that the distance between connecting portions disposed on the corresponding circuits (i.e., the distance between the terminals) is increased, thereby causing the connector to be increased in size. In an electrical connector for circuit boards that has arranged therein, in a housing, multiple blades with electrically conductive elongated members serving as terminals secured in place in array form on insulating plates, the situation of the connecting portions of the electrically conductive elongated members of each blade is the same as described above.

In view of such circumstances, it is an object of the present invention to provide an electrical connector for circuit boards, in which the connecting portions of the electrically conductive elongated members of all the blades can be placed on the corresponding circuits even if the amount of lateral movability is minimal.

Means for Solving the Problem

In the inventive electrical connector for circuit boards, in the front portion of a housing, in which there are formed blades having multiple electrically conductive elongated members aligned and secured in place on insulating plates and which has formed therein holding portions intended for holding multiple blades, there is formed a mating portion intended for the insertion and extraction of a counterpart connector, and, on the bottom of the housing, there is a surface used for mounting to a circuit board, and, furthermore, in which the electrically conductive elongated members have contact portions intended for contacting corresponding terminals in the counterpart connector formed at one end thereof that serves as their front end portion and, at their other end, have connecting portions that are intended to be soldered to corresponding circuits on the circuit board and are formed so as to protrude from the housing.

In the present invention, this electrical connector for circuit boards is characterized by the fact that the holding portions formed in the above-mentioned housing have, for each blade, holding grooves that hold the front portion of each blade, and at least one of the above-mentioned multiple blades is fixedly secured in place within a corresponding holding groove while the rest of the blades are made movable within the respective corresponding holding grooves.

According to the thus configured present invention, one of the multiple blades is fixedly secured in place within a holding groove of the housing. For this reason, the connecting portions of the electrically conductive elongated members of this blade are in a fixed home position relative to the housing. Therefore, when the housing is gripped to bring the connector to a mounting position on the circuit board, the connecting portions that are in the above-mentioned home position can be easily brought to the normal position of the corresponding circuit. This normal position is used as a reference and, as concerns the connecting portions of the other blades, including adjacent blades, it is sufficient to consider the movability of these connecting portions themselves as an offset from the normal position relative to the corresponding circuits, the portions can be precisely placed at locations within a predetermined range that takes the above-mentioned offset relative to the corresponding circuits into account, and there is no need to form enlarged corresponding circuits. In addition, using the connecting portions of the fixedly secured blade as a reference facilitates placement operations performed when mounting the connector to the circuit board.

In addition, due to the fact that one blade is in a fixed home position relative to the housing, the connecting portions of this particular blade can be readily disposed in the normal position relative to the corresponding circuit on the circuit board. Accordingly, the connecting portions of the other blade are also brought to the corresponding circuits within a predetermined range.

The present invention is equally applicable to connectors, in which there is an angle formed between the direction of extension of the contact portions of the electrically conductive elongated members and the direction of extension of the connecting portions. In the present invention, in such a connector, the multiple blades comprise blades of multiple types, in which the length of the electrically conductive elongated members they hold is different for each blade; the above-mentioned electrically conductive elongated members have arm portions that extend in a direction of insertion and extraction in a rectilinear configuration and leg portions that are coupled by the rear ends of said arm portions and curved portions and extend downwardly toward the bottom, with contact portions intended for contacting corresponding terminals in the counterpart connector formed in the front end portions of the arm portions, and connecting portions soldered to the corresponding circuits of the circuit board formed at the lower ends of the leg portions; the various types of blades include arm portion blades, on which the arm portions are secured in place, and leg portion blades, on which the leg portions are secured in place, with the major surfaces of the arm portion blades and leg portion blades forming an angle and being coupled by the curved portions of the electrically conductive elongated members; among the blades of multiple types, the length of the arm and leg portions of the electrically conductive elongated members of the various blades is configured such that the respective arm portion blades and leg portion blades are positioned in a successive manner with intervals provided therebetween; and the holding grooves formed in the housing are formed such that, among the various types of blades, the arm portion blades may be inserted from the back.

Since the arm portion blades and leg portion blades are at right angles and blades other than the blade fixedly secured in place within a holding groove are movable in the direction of insertion and extraction of the counterpart connector, the present invention is also applicable to the so-called right-angle-type connectors.

Effects of the Invention

The present invention, as described above, is a connector containing, within a housing, multiple blades, in which multiple electrically conductive elongated members are held on a single blade. In this connector, a single blade is fixedly secured within the housing while the rest of the blades are secured so as to permit movement. For this reason, the connecting portions of the electrically conductive elongated members of the above-mentioned fixedly secured blade are in a fixed home position relative to the housing. During mounting (e.g., during automated mounting of the connector to a circuit board, and the like), the above-mentioned connecting portions in the home position are used as a reference for easy and precise placement in the normal position on the corresponding circuits of the circuit board which, along with simplifying the mounting operation, results in placing the connecting portions of the other blades on the corresponding circuits within a predetermined range, thereby providing for more precise mounting.

BRIEF DESCRIPTION OF DRAWINGS

FIG. 3(A) shows a cross-section taken at the location of the block portion of the female-type electrical connector, FIG. 3(B) shows a cross-section taken at the location of the guided portion of the female-type electrical connector, and FIG. 3(C) shows an enlarged view of a portion of FIG. 3(B).

FIG. 4(A) shows a cross-section taken at the location of the block portion of the female-type electrical connector and FIG. 4(B) shows a cross-section taken at the location of the guided portion of the female-type electrical connector.

FIG. 5(A) shows its appearance as seen obliquely from above, and FIG. 5(B) as seen obliquely from below.

FIG. 6(A) shows its appearance as seen obliquely from above, and FIG. 6(B) as seen obliquely from below.

DETAILED DESCRIPTION

Embodiments of the present invention will be described below based on the accompanying drawings.

Figure 1:
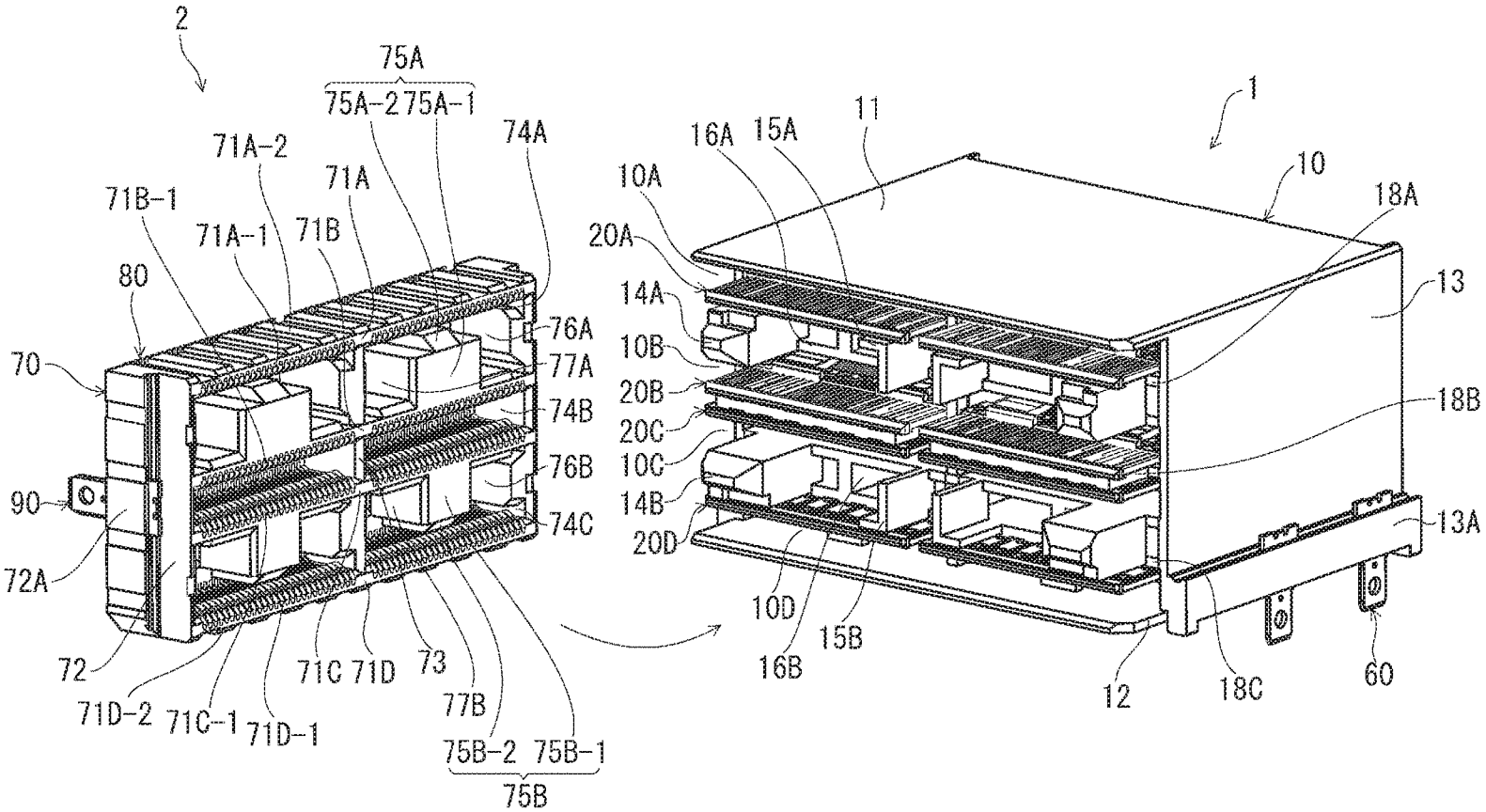
FIG. 1 illustrates a perspective view of a male-type electrical connector and a female-type electrical connector according to an embodiment of the present invention, as seen obliquely from above, showing their appearance in a state prior to connector mating.
Figure 2:
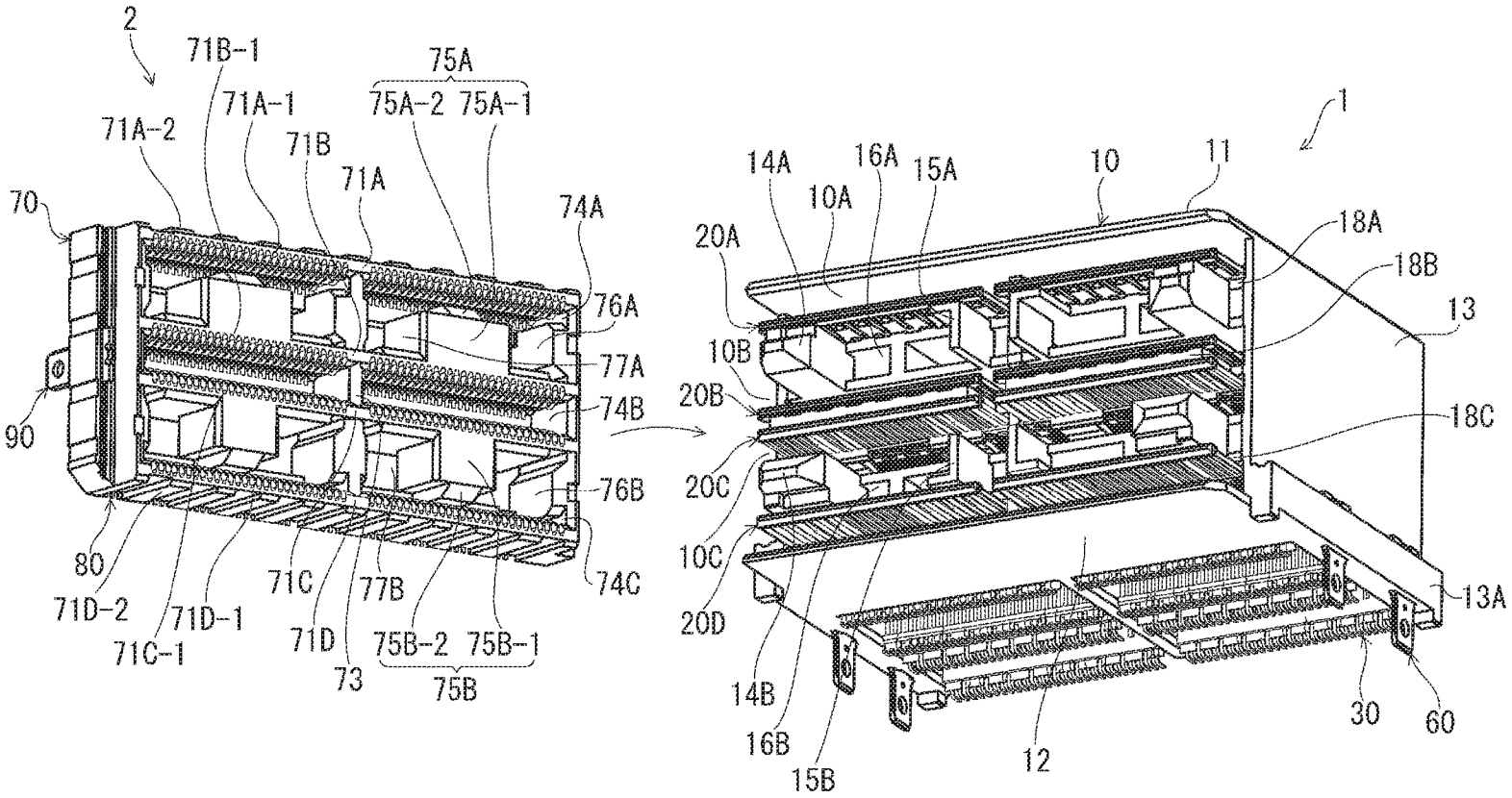
FIG. 2 illustrates a perspective view of the male-type electrical connector and female-type electrical connector of FIG. 1, as seen obliquely from below, showing their appearance in a state prior to connector mating.

FIG. 1, which is a perspective view of a male-type electrical connector 1 (hereinafter referred to simply as "male connector 1") and a female-type electrical connector 2 (hereinafter referred simply as "female connector 2") according to an embodiment of the present invention, as seen obliquely from above, shows their appearance in a state prior to connector mating. FIG. 2, which is a perspective view of the male connector 1 and female connector 2 of FIG. 1 as seen obliquely from below, shows their appearance in a state prior to connector mating. The male connector 1 and female connector 2 of the present embodiment, which are electrical connectors for circuit boards mounted to respective corresponding circuit boards (not shown) by soldering, form an electrical connector assembly by mating with each other. Furthermore, the male connector 1 is a so-called right-angle electrical connector, in which the direction of insertion and extraction to and from the female connector 2 serving as a counterpart connector (longitudinal direction) and the direction, in which the connecting portions soldered to the circuit board are disposed on said circuit board, in other words, the direction of extension of the leg portions of the terminals, on which the connecting portions are formed (vertical direction), are at right angles. In addition, in the present embodiment, the direction that is orthogonal to the above-mentioned two directions (i.e., orthogonal to both the longitudinal direction and the vertical direction) is referred to as the "connector-width direction".

Figure 3A:
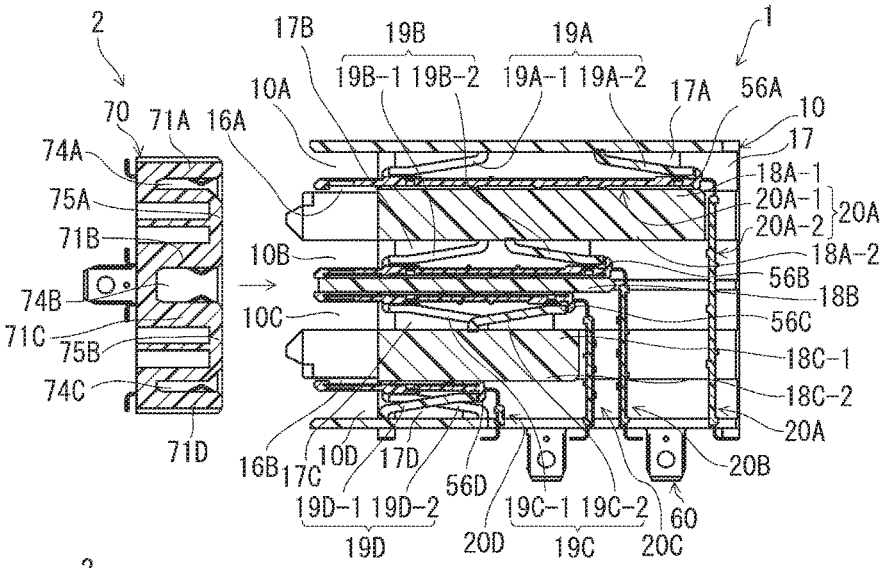
FIG. 3(A) to 3(C) illustrates a cross-sectional view taken along a plane orthogonal to the connector-width direction of the male-type electrical connector and female-type electrical connector in a state prior to connector mating, where
Figure 3B:
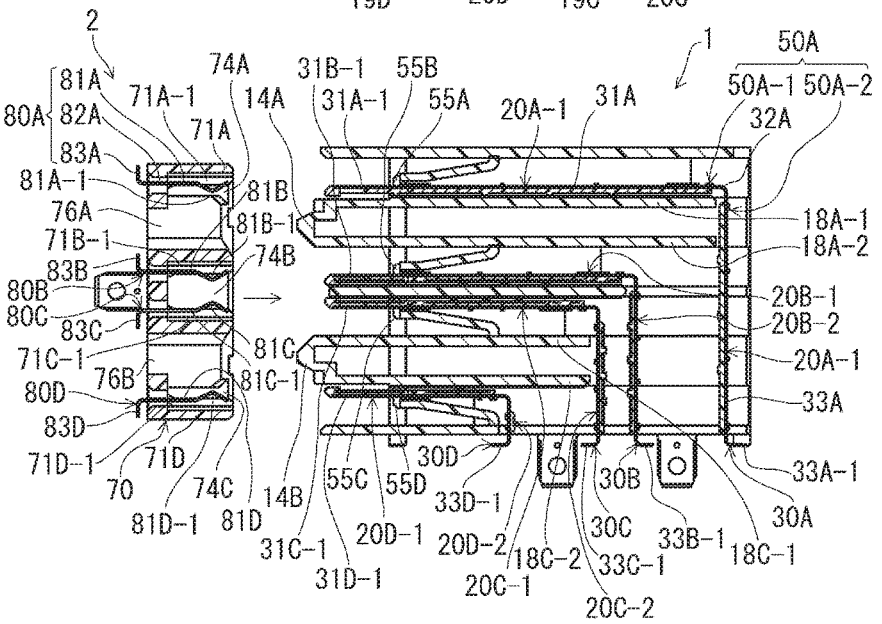
Figure 3C:
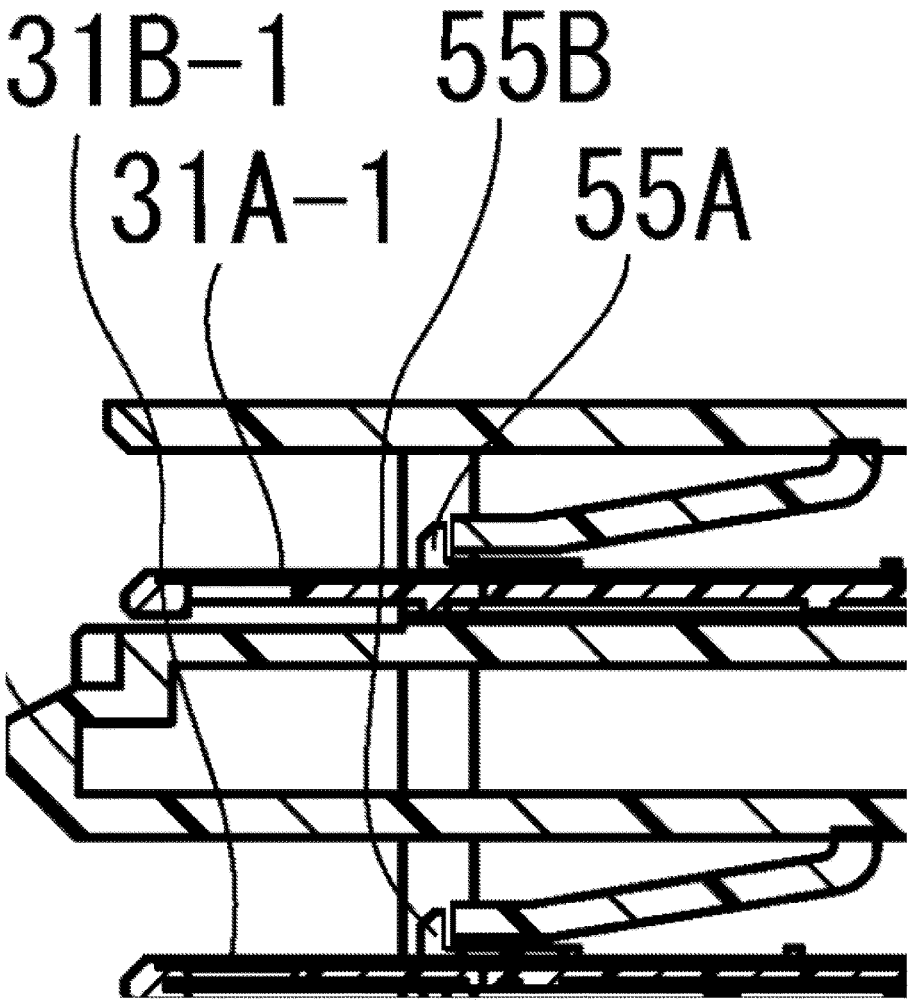
Figure 4A:
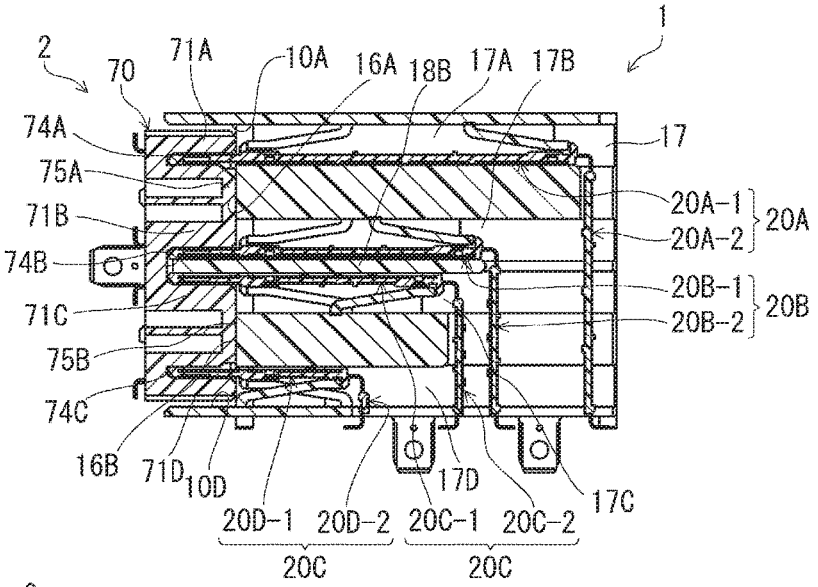
FIGS. 4(A) and 4(B) illustrates a cross-sectional view taken along a plane orthogonal to the connector-width direction of the male-type electrical connector and female-type electrical connector in a mated state, where
Figure 4B:
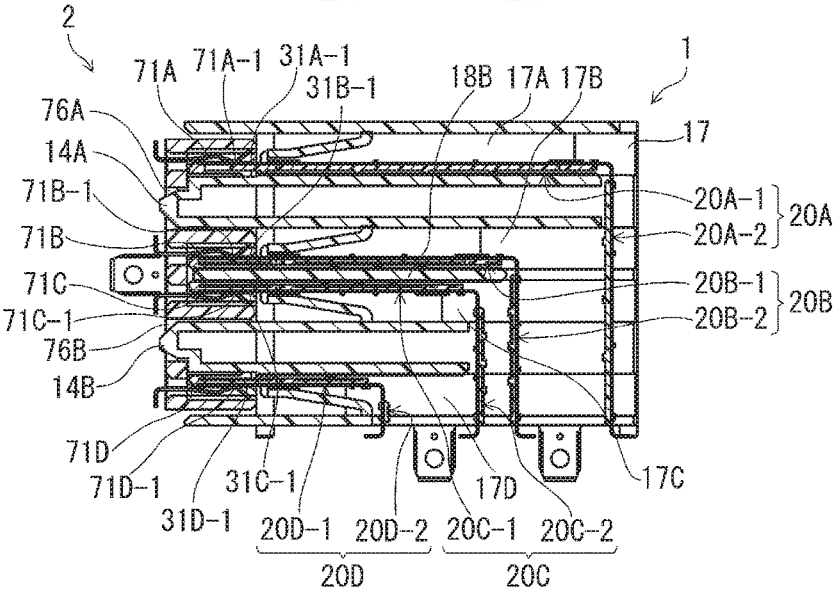

FIGS. 3(A) to 4(B) are cross-sectional views taken along a plane orthogonal to the connector-width direction of the male connector 1 and female connector 2, where FIGS. 3(A) and 3(B) shows a state prior to connector mating, and FIGS. 4(A) and 4(B) shows a connector-mated state. Additionally, FIG. 3(A) and FIG. 4(A) show cross-sections taken at the location of hereinafter-described block portions 75A, 75B in the female connector 2 in the connector-width direction, and FIG. 3(B) and FIG. 4(B) show cross-sections taken at the location of hereinafter-described guided portions 76A, 77B in the female connector 2 in the connector-width direction. In FIGS. 3(A) and 3(B) and FIGS. 4(A) and 4(B), hatching is omitted in the cross-sections of the terminals and in the cross-sections of the shielding plates.

The male connector 1, which is designed for mating with the female connector 2 from the front, has a housing 10, which is formed in substantially rectangular parallelepiped-like external configuration from an electrically insulating material, four types of blades 20A, 20B, 20C, and 20D, which are contained within said housing 10, and mounting members 60, which are used to fixedly mount the housing 10 to a circuit board.

In the present embodiment, as shown in FIGS. 3(A) and 3(B), the four types of blades of different shapes 20A, 20B, 20C, and 20D (hereinafter described as first blade 20A, second blade 20B, third blade 20C, and fourth blade 20D) have substantially "horizontal L-shaped" cross-sections and increase in size in the vertical and longitudinal directions in the order of the blades 20A, 20B, 20C, and 20D. This group of blades 20A, 20B, 20C, 20D (hereinafter referred to as "blade group" if necessary) are secured in place in array form so as to be positioned upwardly and rearwardly in the order of said blades 20A, 20B, 20C, 20D. As described below, the blades 20A, 20B, 20C, 20D have male terminals 30A, 30B, 30C, 30D arranged such that the terminal array direction is the connector-width direction (blade-width direction). As can be seen in FIG. 1 and FIG. 2, the housing 10 is configured to exhibit plane symmetry with respect to a plane (imaginary plane) that is located at a central location in the connector-width direction and is orthogonal to said connector-width direction (also see FIG. 5 (A, B)), with a single blade group respectively secured in place on each side of the above-mentioned plane in the connector-width direction.

As can be seen in FIG. 1 and FIG. 2, the housing 10 has an upper wall 11 and a bottom wall 12, and the side edges of these are coupled by side walls 13, with the upper wall 11 and bottom wall 12 protruding farther forward (leftward in the figure) than the side walls 13. Furthermore, in the space enclosed by the upper wall 11, bottom wall 12, and side walls 13, there are formed, in the sequence mentioned, from top to bottom, a hereinafter-described upper partition 18A, a middle partition 18B, and a lower partition 18C (if necessary, collectively referred to as the "partitions 18A, 18B, 18C"). The front ends of the upper partition 18A and lower partition 18C are located at the same position in the longitudinal direction as the front end of side walls 13, and the front end of the middle partition 18B is located forward of the front end of side walls 13 (also see FIG. 5 (A, B)). In the housing 10, the portion located forward of side walls 13 and partitions 18A, 18B, 18C serves as a mating portion for mating with the female connector 2.

In the above-mentioned mating portion, the front end section of the first blade 20A is positioned in the top part of the space between the upper wall 11 and the middle partition 18B, and the front end section of the second blade 20B is positioned in the lower part of said space. Male connector portions 31A-1 of the male terminals 30A are exposed on the upper face of the front end section of the first blade 20A, and male connector portions 31B-1 of the male terminals 30B are exposed on the upper face of the front end section of the second blade 20B (see FIG. 3 (A, B)). A first connecting space 10A, which is intended to accept a hereinafter-described first terminal retention wall 71A of the female connector 2, is formed between the upper wall 11 and the front end section of the first blade 20A. A second connecting space 10B, which is intended to receive a hereinafter-described second terminal retention wall 71B of the female connector 2, is formed along the above-mentioned second blade 20B directly above the front end section of the second blade 20B.

In addition, a male-side upper mating area, which corresponds to a hereinafter-described female-side upper mating area of the female connector 2, is formed between the first blade 20A and second connecting space 10B. An upper guiding portion 14A, which extends from the upper partition 18A forward at an external position in the connector-width direction, an upper restricting portion 15A, which extends from the upper partition 18A forward at an internal position in the connector-width direction, and an upper block portion receiving space 16A, which is intended to receive a hereinafter-described upper block portion 75A of the female connector 2 between the upper guiding portion 14A and upper restricting portion 15A, are formed in said male-side upper mating area.

In the above-mentioned mating portion, the front end section of the third blade 20C is positioned in the top part of the space between the middle partition 18B and bottom wall 12, and the front end section of the fourth blade 20D is positioned in the bottom part thereof. Male contact portions 31C-1 of the male terminals 30C are exposed on the bottom face of the front end section of the third blade 20C, and male contact portions 31D-1 of the male terminals 30D are exposed on the bottom face of the front end section of the fourth blade 20D (see FIG. 3 (A, B)). A third connecting space 10C intended for receiving a hereinafter-described third terminal retention wall 71C of the female connector 2 is formed along the third blade 20C directly below the front end section of the above-mentioned third blade 20C. A fourth connecting space 10D, which is intended for receiving a hereinafter-described fourth terminal retention wall 71D of the female connector 2, is formed between the bottom wall 12 and the front end section of the fourth blade 20D.

In addition, a male-side lower mating area, which corresponds to a hereinafter-described female-side lower mating area of the female connector 2, is formed between the third connecting space 10C and the fourth blade 20D. A lower guiding portion 14B, which extends forwardly from the lower partition 18C at an external position in the connector-width direction, a lower restricting portion 15B, which extends from the lower partition 18C forward at an internal position in the connector-width direction, and a lower block portion receiving space 16B, which is intended to receive a hereinafter-described lower block portion 75B of the female connector 2 between the lower guiding portion 14B and lower restricting portion 15B, are formed in said male-side lower mating area.

The distal end portions of the guiding portions 14A, 14B, which have a tapered configuration, are designed to guide hereinafter-described block portions 75A, 75B of the female connector 2 into the block portion receiving spaces 16A, 16B. Furthermore, the inner lateral surfaces of said guiding portions 14A, 14B (surfaces facing the restricting portions 15A, 15B in the connector-width direction) serve as restricting surfaces that restrict the movement of the above-mentioned block portions 75A, 75B introduced into the block portion receiving spaces 16A, 16B that is directed outwardly in the connector-width direction.

The upper restricting portion 15A has a vertical wall portion, which has a major surface orthogonal to the connector-width direction and extends in the vertical direction, and a horizontal wall portion, which has a major surface orthogonal to the vertical direction and extends from the upper end of said vertical wall portion outwardly in the connector-width direction, and has an L-shaped cross-section when viewed in the longitudinal direction. The inner lateral surface of said vertical wall portion (the major surface located on the inside in the connector-width direction) serves as a restricting surface that restricts the movement of a hereinafter-described central wall 73 of the female connector 2 in a mated state directed outwardly in the connector-width direction.

The shape of the lower restricting portion 15B, which has a vertical wall portion and a horizontal wall portion, approximates turning the above-described upper restricting portion 15A upside down. In other words, its cross-sectional shape, when viewed in the longitudinal direction, has an inverted L-shaped configuration. The inner lateral surface of said vertical wall portion (the major surface located on the inside in the connector-width direction) serves as a restricting surface that restricts the movement of a hereinafter-described central wall 73 of the female connector 2 in a mated state directed outwardly in the connector-width direction.

In the present embodiment, the guiding portions 14A, 14B, restricting portions 15A, 15B, and block portion receiving spaces 16A, 16B are formed within the terminal array range in the connector-width direction, which makes it possible to ensure a smaller footprint for the male connector 1 in the connector-width direction. In addition, since the upper guiding portion 14A, upper restricting portion 15A, and upper block portion receiving space 16A are positioned so as to mutually overlap within the male-side upper mating area in the vertical direction and the lower guiding portion 14B, lower restricting portion 15B, and lower block portion receiving space 16B are positioned so as to mutually overlap within the male-side lower mating area, it is possible to avoid an increase in the size of the housing 10 and the male connector 1 in the vertical direction.

As can be seen in FIG. 1 and FIG. 2, mounting portions 13A, which protrude outwardly in the connector-width direction, are provided so as to extend at the bottom of side walls 13 of the housing 10 in the longitudinal direction, and mounting members 60 made of sheet metal members are provided on said mounting portions 13A such that they protrude downwardly beyond the bottom wall 12.

As can be seen in FIGS. 3(A) and 3(B), behind the previously described mating portion, the housing 10 has a holding space 17 formed therethrough in the longitudinal direction to serve as a holding portion used to hold the blades 20A to 20D. In addition, as can be seen in FIGS. 3(A) and 3(B), the holding space 17 is open downwardly across the rear half of the housing 10 (right half in FIGS. 3(A) and 3(B)).

Figure 5A:
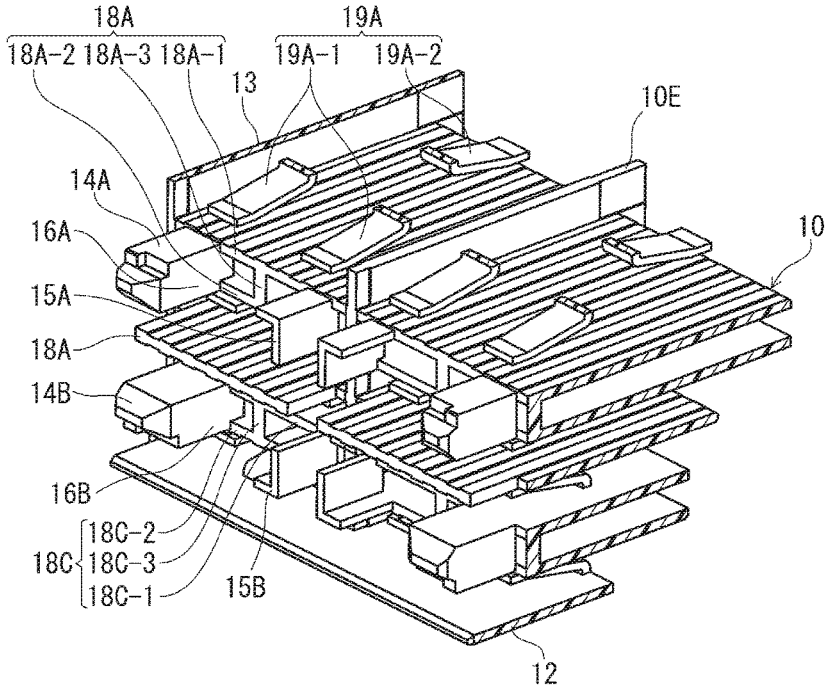
FIGS. 5(A) and 5(B) illustrates a perspective view illustrating a portion of the housing of the male-type electrical connector, where
Figure 5B:
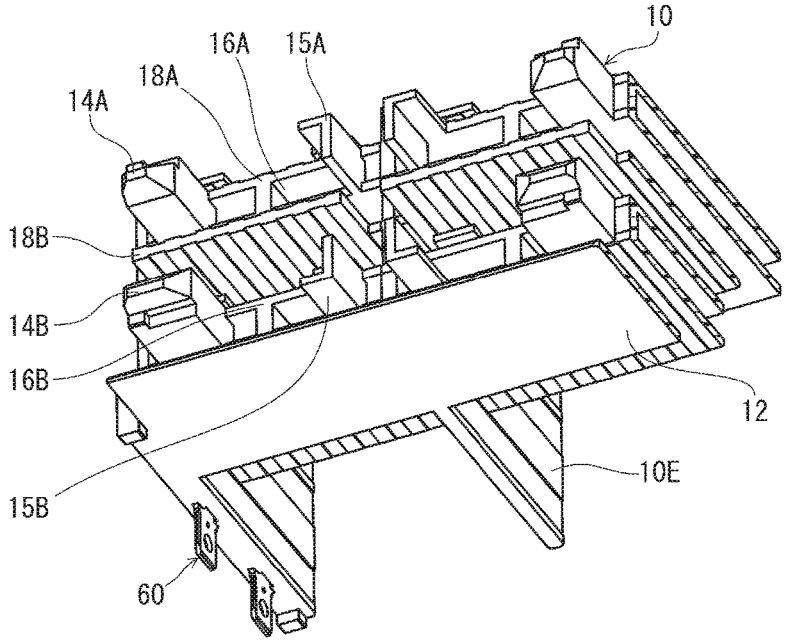

As can be seen in FIG. 3(B) and FIGS. 5(A) and 5(B), the housing 10 has the upper partition 18A, middle partition 18B, and lower partition 18C provided in the sequence mentioned, from top to bottom, within the holding space 17. Within said holding space 17, a first holding groove 17A is formed between the upper wall 11 and the upper partition 18A, a second holding groove 17B is formed between the upper partition 18A and the middle partition 18B, a third holding groove 17C is formed between the middle partition 18B and the lower partition 18C, and a fourth holding groove 17D is formed between the lower partition 18C and the bottom wall 12. As can be seen in FIG. 3(B), hereinafter-described arm portion blades 20A-1 to 20D-1 of the respective blades 20A to 20D are held within the holding grooves 17A to 17D.

In the upper partition 18A, an upper top partition 18A-1 and an upper bottom partition 18A-2, whose major surfaces face each other in the vertical direction, are formed such that they are coupled by multiple upper coupling wall portions 18A-3 (see FIGS. 5(A) and 5(B)) that have major surfaces orthogonal to the connector-width direction and extend in the longitudinal direction. Said upper coupling wall portions 18A-3 are formed between the upper guiding portion 14A and the upper restricting portion 15A in the connector-width direction. The upper top partition 18A-1 extends in the longitudinal direction at the same height level as the top part of the upper guiding portion 14A, and the upper bottom partition 18A-2 extends in the longitudinal direction at the same height level as the bottom part of the upper guiding portion 14A. The upper top partition 18A-1, the upper bottom partition 18A-2, and the upper coupling wall portions 18A-3 extend almost to the rear end of the housing 10.

The middle partition 18B, as a single wall portion, extends in said longitudinal direction at a central location within the holding space 17 in the vertical direction. As previously discussed, the front end of the middle partition 18B is positioned forward of side walls 13, in other words, forward of the holding space 17, and, at the same time, its rear end is positioned forward of the rear end of the upper partition 18A.

In the lower partition 18C, a lower top partition 18C-1 and a lower bottom partition 18C-2, whose major surfaces face each other in the vertical direction, are formed such that they are coupled by multiple lower coupling wall portions 18C-3 that have major surfaces orthogonal to the connector-width direction and extend in the longitudinal direction. Said lower coupling wall portions 18C-3 are formed between the lower guiding portion 14B and the lower restricting portion 15B in the connector-width direction. The lower top partition 18C-1 extends in the longitudinal direction at the same height level as the top part of the lower guiding portion 14B, and the lower bottom partition 18C-2 extends in the longitudinal direction at the same height level as the bottom part of the lower guiding portion 14B. The lower top partition 18C-1, the lower bottom partition 18C-2, and the lower coupling wall portions 18C-3 extend almost to the rear end of the housing 10.

Furthermore, the housing 10 has a central wall 10E, which is located at a central location in the connector-width direction and has major surfaces parallel to side walls 13. Said central wall 10E has substantially the same dimensions in the vertical direction and in the longitudinal direction as the side walls 13 and divides the holding space 17 in two in the connector-width direction by extending across said entire holding space 17 in the vertical direction and in the longitudinal direction. In addition, by extending in the vertical direction, the central wall 10E couples the upper wall 11, upper top partition 18A-1, upper bottom partition 18A-2, middle partition 18B, lower top partition 18C-1, lower bottom partition 18C-2, and the bottom wall 12.

As can be seen in FIGS. 3(A) and 3(B), the housing 10 has provided therein multiple resilient engagement pieces 19A to 19D used to restrict the movement of the blades 20A to 20D in the longitudinal direction. Said resilient engagement pieces 19A to 19D are provided within the respective holding grooves 17A to 17D in a cantilever configuration that is resiliently deformable in the vertical direction, thereby restricting movement of the respective blades 20A to 20D in the longitudinal direction. In the present embodiment, they are made up of multiple first resilient engagement pieces 19A, which extend from the bottom face of the upper wall 11 in the first holding groove 17A and restrict the movement of the first blade 20A, multiple second resilient engagement pieces 19B, which extend from the bottom face of the upper bottom partition 18A-2 and restrict the movement of the second blade 20B, multiple third resilient engagement pieces 19C, which extend from the upper face of the lower top partition 18C-1 and restrict the movement of the third blade 20C, and multiple fourth resilient engagement pieces 19D, which extend from the upper face of the bottom wall 12 and restrict the movement of the fourth blade 20D.

FIG. 5(A) is a perspective view illustrating the appearance of a portion of the housing 10 of the male connector 1 as seen obliquely from above, and FIG. 5(B) as seen obliquely from below. In FIGS. 5(A) and 5(B), the upper wall 11 and the front side wall 13 of the housing 10 are not illustrated.

As can be seen in FIGS. 3(A) 3(B) and FIGS. 5(A) and 5(B), the first resilient engagement pieces 19A have two first forward engagement pieces 19A-1, which extend forwardly toward the vicinity of the front end of the upper top partition 18A-1 at a position located at the front end of the upper wall 11, and a single first rearward engagement piece 19A-2, which extends rearwardly toward the vicinity of the rear end of the upper top partition 18A-1 at a position located at the rear end of the upper wall 11. As is best seen in FIG. 3(A), the first forward engagement pieces 19A-1 and the first rearward engagement piece 19A-2 are provided so as to be spaced apart without an area of mutual overlap in the longitudinal direction. In addition, as can be seen in FIG. 5(A), the first rearward engagement piece 19A-2 is provided at a position located between the two first forward engagement pieces 19A-1 in the connector-width direction.

The second resilient engagement pieces 19B have two second forward engagement pieces 19B-1, which extend forwardly toward the vicinity of the front end of the middle partition 18B at an intermediate position of the upper bottom partition 18A-2 in the longitudinal direction, and a single second rearward engagement piece 19B-2, which extends rearwardly toward the vicinity of the rear end of the middle partition 18B at a position located rearward of said second forward engagement pieces 19B-1. As can be seen in FIG. 3(A), the second forward engagement pieces 19B-1 and the second rearward engagement piece 19B-2 are provided so as to be spaced apart without an area of mutual overlap in the longitudinal direction. In addition, the second rearward engagement piece 19B-2 is provided at a position located between the two second forward engagement pieces 19B-1 in the connector-width direction.

The third resilient engagement pieces 19C have two third forward engagement pieces 19C-1, which extend forwardly toward the vicinity of the front end of said lower top partition 18C-1 at an intermediate position of the lower top partition 18C-1 in the longitudinal direction, and a single third rearward engagement piece 19C-2, which extends rearwardly toward the vicinity of the rear end of said lower top partition 18C-1 at a position located rearward of said third forward engagement pieces 19C-1. As can be seen in FIG. 3(A), the third forward engagement pieces 19C-1 and the third rearward engagement piece 19C-2 are provided such that their base portions have an area of mutual overlap in the longitudinal direction. In addition, the third rearward engagement piece 19C-2 is provided at a position located between the two third forward engagement pieces 19C-1 in the connector-width direction.

The fourth resilient engagement pieces 19D have two fourth forward engagement pieces 19D-1, which extend forwardly from the rear end of the bottom wall 12 toward the vicinity of the front end of the lower bottom partition 18C-2, and a single fourth rearward engagement piece 19D-2, which extends rearwardly from the front end of the lower bottom partition 18C-2 toward the vicinity of the rear end of the bottom wall 12. As can be seen in FIG. 3(A), the fourth forward engagement pieces 19D-1 and the fourth rearward engagement piece 19D-2 are positioned such that some sections thereof, with the exception of their base portions, have an area of mutual overlap in the longitudinal direction. In addition, the fourth rearward engagement piece 19D-2 is provided at a position located between the two fourth forward engagement pieces 19D-1 in the connector-width direction.

The four types of blades 20A to 20D are fabricated by aligning and securing in place multiple terminals on insulating plates. Although the lengths of the respective insulating plates and terminals of these four types of blades 20A to 20D are different, they share a basic configuration. For this reason, the configuration of the first blade 20A will be explained first, and the configuration of the second blade 20B, third blade 20C, and fourth blade 20D will be explained by focusing on their differences from the other blades.

Figure 6A:
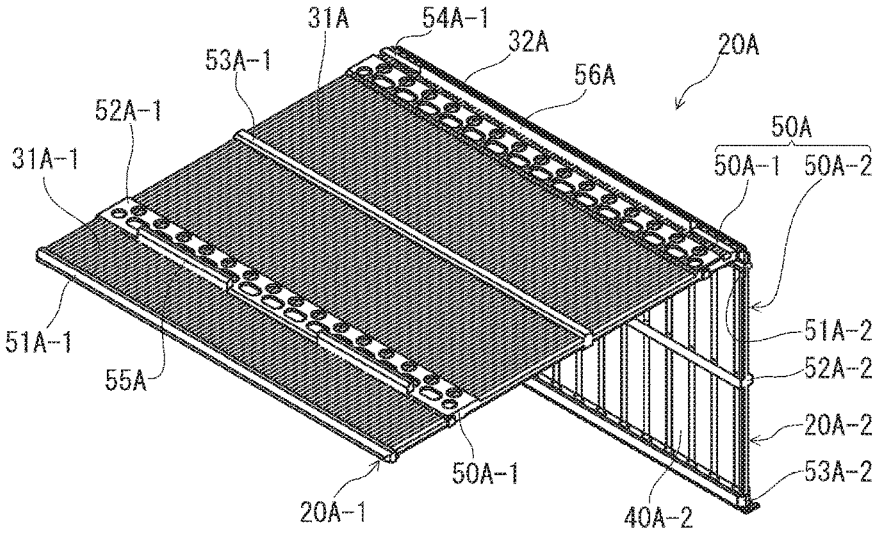
FIGS. 6(A) and 6(B) illustrates a perspective view of the first blade of the male-type electrical connector, where
Figure 6B:
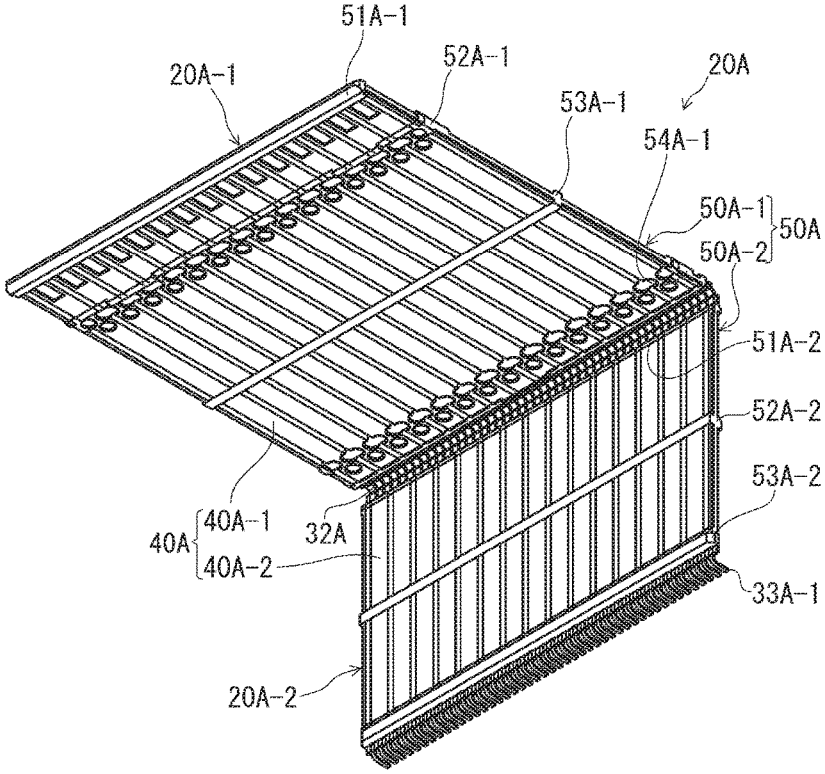

FIG. 6(A) is a perspective view of the first blade 20A of the male-type electrical connector 1 as seen from above, and FIG. 6(B) is a perspective view as seen from below. As can be seen in FIGS. 6(A) and 6(B), the first blade 20A has multiple male terminals 30A serving as electrically conductive elongated members arranged in the connector-width direction, shielding plates 40A provided so as to cover the terminal array region, and insulating plates 50A that secure the male terminals 30A and shielding plates 40A in place by unitary co-molding.

While all the male terminals 30A are made to be of the same shape, some of the male terminals 30A among them are used as signal terminals, and other male terminals 30A are used as ground terminals. The male terminals 30A, which are electrically conductive elongated members made by bending metal strips in the through-thickness direction, have arm portions 31A, which extend in a rectilinear configuration in the longitudinal direction (connector insertion/extraction direction), curved portions 32A, which are downwardly bent at right angles at the rear ends of said arm portions 31A, and leg portions 33A, which are coupled to the arm portions 31A through the medium of said curved portions 32A and extend downwardly toward the bottom of the housing 10.

As can be seen in FIG. 3(A), the arm portions 31A, which extend in the longitudinal direction along the upper face of a hereinafter-described arm portion insulating plate 50A-1, are secured and held in place by the arm portion insulating plate 50A-1 throughout the entire length. As can be seen in FIG. 6(A), most of the upper face (major surface) of said arm portions 31A is exposed on the upper face of the arm portion insulating plate 50A-1, and the upper faces (exposed surfaces) of the front end sections of said arm portions 31A are formed as male contact portions 31A-1 placed in contact with female terminals 80 provided in the female connector 2 (see FIG. 1 and FIG. 2).

As can be seen in FIG. 3(B), the leg portions 33A, which extend in the vertical direction along the rear face of a hereinafter-described leg portion insulating plate 50A-2 (right face in FIG. 3(B)), are secured and held in place by the leg portion insulating plate 50A-2 throughout the entire length. Most of the rear face (major surface) of said leg portions 33A is exposed on the rear face of the leg portion insulating plate 50A-2. The lower end portions of said leg portions 33A, which are bent at right angles and extend rearwardly, are formed as connecting portions 33A-1 soldered to the corresponding circuits of the circuit board (not shown).

As can be seen in FIG. 6(B), the shielding plates 40A have arm portion shielding plates 40A-1, which are provided for the arm portions 31A of the male terminals 30A, and leg portion shielding plates 40A-2, which are provided for the leg portions 33A of the male terminals 30A. The arm portion shielding plates 40A-1, which are provided along the bottom face of the hereinafter-described arm portion insulating plate 50A-1, extend across substantially the entire length of the arm portions 31A in the longitudinal direction and also extend across the entire terminal array range in the connector-width direction (terminal array direction).

As can be seen in FIG. 6(B), the leg portion shielding plates 40A-2, which are provided along the front face of the hereinafter-described leg portion insulating plate 50A-2 (left face in FIG. 3(B)), extend across substantially the entire length of the leg portions 33A in the vertical direction and also extend across the entire terminal array range in the connector-width direction (terminal array direction).

In the present embodiment, the arm portion shielding plates 40A-1 and leg portion shielding plates 40A-2 have protruding sections protruding on the side facing the male terminals 30A at positions corresponding to said male terminals 30A serving as ground terminals in the connector-width direction, which makes it possible to establish electrical conductivity with said male terminals 30A by placing said protruding sections in contact with the above-mentioned male terminals 30A.

As can be seen in FIGS. 3(A) and 3(B) and FIGS. 6(A) and 6(B), the insulating plate 50A has an arm portion insulating plate 50A-1, which is provided for the arm portions 31A of the terminals 30A, and a leg portion insulating plate 50A-2, which is provided for the leg portions 33A of the terminals 30A.

The arm portion insulating plate 50A-1 is a plate-shaped member made of resin and, as can be seen in FIGS. 3(A) and 3(B) and FIGS. 6(A) and 6(B), extends across substantially the entire length of the arm portions 31A in the longitudinal direction and also extends across the entire terminal array range in the connector-width direction (terminal array direction). As can be seen in FIGS. 6 (A) and 6(B), said arm portion insulating plate 50A-1 has formed thereon, on its upper face and bottom face, at four positions in the longitudinal direction, retaining portions MA-1 to 54A-1 extending throughout the entire range in the connector-width direction. Specifically, the front end retaining portion 51A-1 is formed at the front end of the arm portion insulating plate 50A-1, the front intermediate retaining portion 52A-1 is formed at a front intermediate position, the rear intermediate retaining portion 53A-1 is formed at a rear intermediate position, and the rear end retaining portion 54A-1 is formed at the rear end. Said retaining portions 51A-1 to 54A-1 cover the upper faces of the arm portions 31A of the terminals 30A, as well as the bottom faces of the arm portion shielding plates 40A-1, as a result of which the arm portions 31A and arm portion shielding plates 40A-1 are secured in place by the arm portion insulating plate 50A-1 in a more reliable manner. In the present embodiment, the front intermediate retaining portion 52A-1 is positioned in correspondence with front end portions of the first forward engagement pieces 19A-1 of the housing 10 in the longitudinal direction, and the rear end retaining portion MA-1 is positioned in correspondence with the rear end portion of the first rearward engagement piece 19A-2 of the housing 10 in the longitudinal direction.

In addition, as can be seen in FIG. 6(A), the arm portion insulating plate 50A-1 has two forward engagement protrusions 55A, which upwardly protrude from the upper face of the front intermediate retaining portion 52A-1 and extend in the connector-width direction, and a single rearward engagement protrusion 56A, which upwardly protrudes from the upper face of the rear end retaining portion 54A-1 and extends in the connector-width direction. The two forward engagement protrusions 55A are formed at locations corresponding to the two first forward engagement pieces 19A-1 of the housing 10 in the connector-width direction (se FIG. 3(A), FIG. 5(A), and FIG. 6(A)). As can be seen in FIG. 6(A), the rearward engagement protrusion 56A is formed across most of the intermediate area (the area excluding the two end areas) of the rear end retaining portion 54A-1 in the connector-width direction and is positioned in correspondence with the first rearward engagement piece 19A-2 of the housing 10 in the connector-width direction (see FIG. 3(A), FIG. 5(A), and FIG. 6(A)).

As discussed below, engagement between the forward engagement protrusions 55A and the front ends of the first forward engagement pieces 19A-1 restricts rearward movement of the arm portion blade 20A-1 and, in turn, the first blade 20A in excess of a predetermined amount (see FIG. 3(A)). Also, engagement between the rearward engagement protrusions 56A and the rear end of the first rearward engagement piece 19A-2 restricts forward movement of the arm portion blade 20A-1 and, in turn, the first blade 20A in excess of a predetermined amount (see FIG. 3(A)). In the present embodiment, the distance between the engagement protrusions 55A, 56A in the longitudinal direction is configured to be slightly larger than the distance between the distal ends (free ends) of the resilient engagement pieces 19A-1, 19A-2 in the longitudinal direction. Namely, there is a gap (play) in the longitudinal direction between the engagement protrusions 55A, 56A and the resilient engagement pieces 19A-1, 19A-2. The arm portion blade 20A-1 and, in turn, the first blade 20A, are movable within this gap in the longitudinal direction with a certain degree of freedom.

In addition, the arm portion insulating plate 50A-1 has a front restricting protrusion, which protrudes downwardly from the bottom face of the front intermediate retaining portion 52A-1 and extends in the connector-width direction, and a rear restricting protrusion, which protrudes downwardly from the bottom face of the rear end retaining portion MA-1 and extends in the connector-width direction. The arm portion blade 20A-1 abuts the upper face of the upper top partition 18A-1 (see FIG. 3(A)) with these restricting protrusions A, thereby impeding contact between the arm portion blade 20A-1 and the upper face of the upper top partition 18A-1 throughout the entire length thereof in the longitudinal direction. As a result, as discussed below, when the arm portion blade 20A-1 moves obliquely within the first holding groove 17A, even if this is accompanied by movement in the longitudinal direction, the friction between the arm portion blade 20A-1 and the upper face of the upper top partition 18A-1 is reduced and the movement is not hindered in any way.

The leg portion insulating plate 50A-2 is a plate-shaped member made of resin and, as can be seen in FIGS. 3(A) and 3(B) and FIGS. 6(A) and 6(B), it extends across substantially the entire length of the leg portions 33A in the vertical direction and also extends across the entire terminal array range in the connector-width direction (terminal array direction). Retaining portions 51A-2 to 53A-2 are formed at three locations in the vertical direction on the front and rear faces of said leg portion insulating plate 50A-2, extending throughout the entire range in the connector-width direction. Specifically, an upper end retaining portion 51A-2 is formed at the upper end of the leg portion insulating plate 50A-2, an intermediate retaining portion 52A-2 is formed at an intermediate position, and a lower end retaining portion 53A-2 is formed at the lower end. Said retaining portions 51A-2 to 53A-2 cover the rear face of the leg portions 33A of the terminals 30A as well as the front face of the leg portion shielding plates 40A-2, as a result of which the leg portions 33A and the leg portion shielding plates 40A-2 are more reliably secured in place on the leg portion insulating plate 50A-2.

Regarding the first blade 20A, the arm portion shielding plates 40A-1 and the arm portions 31A of the multiple terminals 30A are secured in place on the arm portion insulating plate 50A-1 by unitary co-molding, and, furthermore, the leg portion shielding plates 40A-2 and the leg portions 33A of the multiple terminals 30A are secured in place on the leg portion insulating plate 50A-2. The thus fabricated first blade 20A is configured such that the arm portion blade 20A-1, which has arm portions 31A, arm portion shielding plates 40A-1, and an arm portion insulating plate 50A-1, and the leg portion blade 20A-2, which has leg portions 33A, leg portion shielding plates 40A-2, and a leg portion insulating plate 50A-2, are at right angles to each other and are coupled by the curved portions 32A of the terminals 30A.

As can be seen in FIG. 3(B), the second blade 20B has a configuration obtained by making the arm portion blade 20A-1 of the first blade 20A shorter in the longitudinal direction and also shortening the leg portion blade 20A-2 in the vertical direction. In other words, the insulating plates, shielding plates, leg portion, and arm portion of the male terminals of the second blade 20B are respectively shorter than the insulating plates 50A-1, 50A-2, shielding plates 40A-1, 40A-2, leg portion 33A, and arm portion 31A of the terminals 30A of the first blade 20A.

As can be seen in FIG. 3(B), the third blade 20C has a configuration obtained by making the arm portion blade 20B-1 of the second blade 20B shorter in the longitudinal direction and also shortening the leg portion blade 20B-2 in the vertical direction. In other words, the insulating plates, shielding plates, leg portion, and arm portion of the male terminals of the third blade 20C are respectively shorter than the insulating plates, shielding plates, leg portion, and arm portion of the male terminals of the second blade 20B. In addition, said third blade 20C differs from the second blade 20B in that connecting portions of the male terminals extend forwardly, the engagement protrusions of the arm portion insulating plate protrude downwardly, and the restricting protrusions of the arm portion insulating plate protrude upwardly.

The fourth blade 20D has a configuration obtained by making the arm portion blade 20C-1 of the third blade 20C shorter in the longitudinal direction and also shortening the leg portion blade 20C-2 in the vertical direction. In other words, the insulating plates, shielding plates, leg portion, and arm portion of the male terminals of the fourth blade 20D are respectively shorter than the insulating plates, shielding plates, leg portion, and arm portion of the male terminals of the third blade 20C.

The assembly of the connector 1 will be described next. The connector 1 is assembled by mounting the four types of blades 20A to 20D to the housing 10 from the back in the following order, namely, fourth blade 20D, third blade 20C, second blade 20B, and first blade 20A.

First, the mounting members 60 are attached to the mounting portions 13A of the housing 10 (see FIG. 1 and FIG. 2) by press-fitting from above. The mounting of the mounting members 60 can be performed either after the mounting of the blades 20A to 20D or simultaneously therewith. In addition, the mounting members 60 may be mounted by press-fitting from above or mounted by unitary co-molding with the housing 10.

Next, the arm portion blade 20D-1 of the fourth blade 20D is inserted into the fourth holding groove 17D by moving it forwardly along the bottom face of the lower bottom partition 18C-2 of the housing 10. In the process of insertion, the forward engagement protrusions 55D of the arm portion blade 20D-1 abut the fourth rearward engagement piece 19D-2 and cause said fourth rearward engagement piece 19D-2 to undergo downward resilient deformation, thereby permitting further insertion of the arm portion blade 20D-1.

Furthermore, when the arm portion blade 20D-1 is inserted and the forward engagement protrusions 55D reach a position located forward of the front end of the fourth rearward engagement piece 19D-2, the fourth rearward engagement piece 19D-2 returns to its free state. As a result, as can be seen in FIG. 3(B), the front end of the fourth rearward engagement piece 19D-2 engages with the forward engagement protrusions 55D behind said forward engagement protrusions 55D, thereby obstructing backward movement of the arm portion blade 20D-1 and, in turn, the fourth blade 20D. In addition, at such time, as can be seen in FIG. 3(A), the rear ends of the fourth forward engagement pieces 19D-1 engage with the rearward engagement protrusion 56D in front of said rearward engagement protrusion 56D, thereby obstructing forward movement of the arm portion blade 20D-1 and, in turn, the fourth blade 20D. Therefore, the arm portion blade 20D-1 is secured in place without creating a gap (play) in the longitudinal direction. Furthermore, the arm portion blade 20D-1 is secured in place in the vertical direction under pressure from the fourth forward engagement pieces 19D-1 and the fourth rearward engagement piece 19D-2 applied from below to the bottom face of the lower bottom partition 18C-2. In other words, the fourth blade 20D is rigidly secured in place by the housing 10. As can be seen in FIG. 3(A), the connecting portions 33D-1 of the male terminals 30D are located below the bottom face of the bottom wall 12 of the housing 10.

Next, the same procedure as during the above-mentioned mounting of the fourth blade 20D is used to mount the blades 20C, 20B, and 20A to the housing 10 by inserting the arm portion blade 20C-1 of the third blade 20C, arm portion blade 20B-1 of the second blade 20B, and arm portion blade 20A-1 of the first blade 20A into, respectively, the third holding groove 17C, second holding groove 17B, and first holding groove 17A from the back. As a result, the blades 20A to 20D are held inside the housing 10 in a state in which the arm portion blades 20A-1 to 20D-1 are positioned in the vertical direction and the leg portion blades 20A-2 to 20D-2 are positioned in the longitudinal direction with intervals therebetween. In addition, as can be seen in FIG. 3 (A), the connecting portions 33A-1 to 33C-1 of the male terminals 30A to 30C of the blades 20A to 20C are positioned below the bottom face of the bottom wall 12 of the housing 10.

Once the mounting of the blades 20A to 20C to the housing 10 is complete, the arm portion blades 20A-1 to 20C-1 are positioned such that the forward engagement protrusions 55A to 55C can be engaged with the forward engagement pieces 19A-1 to 19C-1 and, in addition, the rearward engagement protrusions 56A to 56C can be engaged with the rearward engagement pieces 19A-2 to 19C-2 with a slight gap in the longitudinal direction, and, furthermore, with a slight gap in the vertical direction between the restricting protrusions and the surfaces of the partitions 18A, 18B facing them. Therefore, the blades 20A to 20C permit some movement in the longitudinal and vertical directions with a certain degree of freedom within the above-mentioned gap (play) and this is what sets them apart from the fourth blade 20D, which is rigidly secured in place.

The connector 1 according to the present embodiment is mounted to the mounting surface of the circuit board in the following manner. First, once the housing 10 of the connector 1 is secured in place, the bottom wall 12 of the housing 10 is positioned so as to face the mounting surface of the circuit board and the connecting portions 33A-1 to 33D-1 of the blades 20A to 20D of different types are disposed on the corresponding circuits located on the mounting surface. In the present embodiment, the fourth blade 20D is rigidly secured in place by the housing 10 and, for this reason, the connecting portions 33D-1 are in a fixed home position relative to the housing 10. Therefore, the connecting portions 33D-1 in this home position can be easily brought to the normal position of the above-mentioned corresponding circuit. In other words, in the present embodiment, this normal position is used as a reference and, as concerns the connecting portions 33A-1 to 33C-1 of the other blades 20A to 20C, it is sufficient to consider the movability in the longitudinal direction of these connecting portions 33A-1 to 33C-1 themselves as an offset from the normal position relative to the corresponding circuits. As a result, this allows for precise placement at locations within a predetermined range that takes the above-mentioned offset relative to the corresponding circuits into account, and there is no longer need to form enlarged corresponding circuits. In addition, since the position of the connecting portions 33D-1 of the fixedly secured fourth blade 20D can be used as a reference, placement operations can be easily and precisely performed when the connector is mounted to a circuit board.

Although in the present embodiment the fixedly secured blade is the fourth blade 20D, instead of the fourth blade 20D, any of the other blades (i.e., 20A, 20B, or 20C) may be fixedly secured and the position of said blade may be used as a reference during mounting to a circuit board. In addition, while in the present embodiment the fourth blade 20D is the only fixedly secured blade, instead of that, two or three blades may be secured in place and at least one position of the fixedly secured blades may be used as a reference during mounting to a circuit board.

Furthermore, if the heightwise positions of the connecting portions 33A-1 to 33D-1 of all the blades 20A to 20D are aligned prior to the placement of the connector 1 on the above-mentioned mounting surface, then the state of alignment of the connecting portions 33A-1 to 33D-1 is maintained as is without the hereinafter-described oblique movement of the blades 20A to 20D even after said connector 1 is placed on the mounting surface.

On the other hand, if the heightwise positions of the connecting portions 33A-1 to 33D-1 of all the blades 20A to 20D prior to the placement of the connector 1 on the above-mentioned mounting surface are misaligned due to manufacturing errors, in the present embodiment, as discussed below, the misalignment of the heightwise positions of the connecting portions 33A-1 to 33D-1 is automatically corrected when the connector 1 is placed on the mounting surface.

When the connector 1 is placed on the mounting surface, the connecting portions 33A-1 to 33C-1 of the blades 20A to 20C abut the above-mentioned corresponding circuits and are subject to an abutment force acting upwardly from said corresponding circuits, as a result of which blades that have connecting portions positioned below other connecting portions assume an oblique orientation within the holding space 17 of the housing 10, such that the rear portion of the arm portion blades is raised.

For example, in the event that, among the connecting portions 33A-1 to 33D-1, only the connecting portions 33A-1 of the first blade 20A are positioned below the other connecting portions 33B-1 to 33D-1, said connecting portions 33A-1 are subject to the above-mentioned abutment force originating from the corresponding circuit and, as a result, are upwardly raised by the amount of offset of the heightwise position. As a result, depending on how much the connecting portions 33A-1 are raised, the first blade 20A assumes the above-mentioned oblique orientation within the holding space 17. The oblique movement of the first blade 20A occurs within the range of "play" in the vertical direction in the first holding groove 17A, in other words, within the space formed between the first resilient engagement pieces 19A on the one hand, and the upper top partition 18A-1 and the arm portion blade 20A-1 on the other hand. In this manner, as the first blade 20A assumes an oblique orientation, the heightwise positions of said connecting portions 33A-1 and the connecting portions 33B-1 to 33D-1 become aligned.

While the discussion above has described a case in which only one type of blade has its connecting portions offset in terms of their heightwise position, the same applies to cases in which the heightwise positions of the connecting portions of multiple types of blades are respectively in misalignment. Namely, blades other than the blade having connecting portions positioned in the uppermost position prior to placement on the mounting surface of the circuit board assume the above-described oblique orientation due to the above-mentioned abutment force, as a result of which the heightwise positions of all the connecting portions 33A-1 to 33D-1 are aligned with the position of the above-mentioned connecting portion in the uppermost position.

Thus, the heightwise positions of all the connecting portions 33A-1 to 33D-1 become aligned, as a result of which all of said connecting portions 33A-1 to 33D-1 can be held in reliable contact with the corresponding circuits. Then, an adequate solder connection for all the connecting portions 33A-1 to 33D-1 can be ensured by solder connecting said connecting portions 33A-1 to 33D-1 to the corresponding circuits. In addition, the mounting members 60 are soldered to the corresponding portions of the circuit board.

Furthermore, in the present embodiment, the arm portion blades 20A-1 to 20C-1 are freely movable in the vertical direction within the above-described range of "play" inside the holding grooves 17A to 17C and even if the arm portion blades 20A-1 to 20C-1 are tilted, they are not acted upon by external forces. For this reason, no residual stress is generated in the connecting portions 33A-1 to 33C-1 disposed on the mounting surface. Consequently, no residual stress is generated in soldered locations, which makes it possible to reliably maintain adequate solder connections.

In addition, in the present embodiment, there are restricting protrusions formed on the arm portion blades 20A-1 to 20D-1, thereby obstructing contact between the inner surfaces of the holding grooves 17A to 17D and the major surfaces of said arm portion blades 20A-1 to 20D-1. Consequently, of said arm portion blades 20A-1 to 20D-1, the arm portion blades 20A-1 to 20C-1 move inside the holding grooves 17A to 17C under the action of the above-described abutment force and the resilient force of the resilient engagement pieces, as a result of which, when the major surfaces on the side opposite to the resilient engagement pieces 19A to 19C approach the inner surfaces of the holding grooves 17A to 17C, said arm portion blades 20A-1 to 20C-1 abut the above-mentioned inner surfaces using only the restricting protrusions. As a result, the friction force between the arm portion blades 20A-1 to 20C-1 and the inner surfaces of the holding grooves 17A to 17C is reduced. For this reason, even if the movement of the arm portion blades 20A-1 to 20C-1 in the vertical direction involves movement in the longitudinal direction, there are no obstacles whatsoever to this movement.

Next, the configuration of the female connector 2 will the described with reference to FIG. 1, FIG. 2, and FIGS. 3(A) and 3(B). Said female connector 2 is mated with the male connector 1 toward the rear (on the right side in FIG. 1, FIG. 2, and FIGS. 3(A) and 3(B)). Said female connector 2 has a rectangular parallelepiped-shaped housing 70 adapted for the mating portion of the connector 1, multiple female terminals 80 serving as counterpart terminals secured in place in array form on said housing 70, and mounting members 90 secured in place on said housing 70. The female connector 2 has a configuration exhibiting plane symmetry with respect to a plane (imaginary plane) orthogonal to the connector-width direction located at a central location in said connector-width direction.

As can be seen in FIG. 1 and FIG. 2, the housing 70 has four terminal retention walls 71A, 71B, 71C, 71D, which have major surfaces orthogonal to the vertical direction and extend in the connector-width direction; two side walls 72, which have major surfaces orthogonal to said connector-width direction, extend in the vertical direction, and couple the ends of the above-mentioned four terminal retention walls 71A, 71B, 71C, 71D in the connector-width direction; and a central wall 73, which is parallel to said side walls 72, extends in the vertical direction at a central location in the connector-width direction, and couples the above-mentioned four terminal retention walls 71A, 71B, 71C, 71D.

The terminal retention walls 71A, 71B, 71C, 71D, which are disposed from top to bottom so as to be parallel to one another, are provided so as to correspond respectively to the blades 20A, 20B, 20C, 20D of the male connector. Below, whenever it is necessary to distinguish between the terminal retention walls 71A, 71B, 71C, 71D, the walls are referred to respectively as the "first terminal retention wall 71A", "second terminal retention wall 71B", "third terminal retention wall 71C", and "fourth terminal retention wall 71D".

In the first terminal retention wall 71A, which constitutes the upper wall of the housing 70, there are formed terminal retention grooves 71A-1 used to secure the female terminals 80 in place. The grooves, which are sunk into the bottom face, extend in the longitudinal direction and are formed in an array configuration in the connector-width direction. In said first terminal retention wall 71A, projection portions 71A-2, which protrude from the upper face and extend in the longitudinal direction, are formed in an array configuration in the connector-width direction, with the strength of the wall improved by said projection portions 71A-2.

In the second terminal retention wall 71B, in the same manner as in the above-described first terminal retention wall 71A, there are formed terminal retention grooves 71B-1 used to secure the female terminals 80 in place. The grooves, which are sunk into the bottom face, extend in the longitudinal direction and are formed in an array configuration in the connector-width direction.

The third terminal retention wall 71C, whose shape approximates turning the above-described second terminal retention wall 71B upside down, has terminal retention grooves 71C-1 formed in an array configuration on its upper face. The shape of the fourth terminal retention wall 71D, which constitutes the bottom wall of the housing 70, approximates turning the above-described first terminal retention wall 71A upside down, and has terminal retention grooves 71D-1 formed in an array configuration on its upper face and the projection portions 71D-2 formed in an array configuration on its bottom face.

Vertically extending mounting portions 72A, which protrude outwardly in the connector-width direction, are provided in the front portion of the side walls 72. Mounting members 90, which are made of sheet metal members, are provided so as to protrude forwardly of the front end face of the housing 70. The central wall 73 extends throughout the entire housing 70 in the vertical direction and in the longitudinal direction at a central location in the connector-width direction, thereby dividing the mating portion in two in the connector-width direction.

An upper blade receiving space 74A, which extends along the bottom face of said first terminal retention wall 71A and is intended to receive the front end portion of the first blade 20A of the male connector 1, and, underneath said upper blade receiving space 74A, a female-side upper mating area corresponding to the male-side upper mating area of the male connector 1 are formed between the first terminal retention wall 71A and the second terminal retention wall 71B. In said female-side upper mating area, there are formed an upper block portion 75A, which protrudes upwardly from the upper face of the second terminal retention wall 71B in the central area of said female-side upper mating area in the connector-width direction and also extends in the longitudinal direction, an upper guided portion 76A, which comprises a space that penetrates in the longitudinal direction on the outside of said upper block portion 75A in the connector-width direction, and an upper restricted portion 77A, which comprises a space that penetrates in the longitudinal direction on the inside of said upper block portion 75A in the connector-width direction.

The upper block portion 75A has a prismatic upper prism portion 75A-1, which protrudes upwardly from the upper face of the second terminal retention wall 71B, and an upper supporting portion 75A-2, which protrudes from the upper face of said upper prism portion 75A-1 and also extends in the longitudinal direction. Said upper block portion 75A is formed integrally with the second terminal retention wall 71B and has considerable thickness dimensions in the vertical direction, thereby reinforcing said second terminal retention wall 71B. In addition, in the upper prism portion 75A-1, the lateral surface facing outwardly in the connector-width direction constitutes a restricted surface that abuts the inner lateral surface of the upper guiding portion 14A of the male connector 1 when the connector is in a mated state and is restricted from moving in the connector-width direction. The upper supporting portion 75A-2 stabilizes the position of the first blade 20A in the vertical direction by supporting said first blade 20A of the male connector 1 from below when the connector is in a mated state.

The upper guided portion 76A is a space for receiving and holding the upper guiding portion 14A of the male connector 1 from the back when the connector is in a mated state. The inner wall surface of the side wall 72 that forms said upper guided portion 76A constitutes a restricted surface that abuts the outer lateral surface of the upper guiding portion 14A and is restricted from moving in the connector-width direction.

The upper restricted portion 77A is a space for receiving and holding the restricting portion 15A of the male connector 1 from the back when the connector is in a mated state. The lateral face of the central wall 73 that forms said upper restricted portion 77A constitutes a restricted surface that abuts the lateral face of the vertical wall portion of the above-mentioned restricting portion 15A and is restricted from moving in the connector-width direction.

A middle blade receiving space 74B, which is intended to receive the front end sections of, respectively, the second blade 20B, third blade 20C, and middle partition 18B of the male connector 1, is formed between the second terminal retention wall 71B and the third terminal retention wall 71C.

A lower blade receiving space 74C, which extends along the upper face of said fourth terminal retention wall 71D and is intended to receive the front end portion of the fourth blade 20D of the connector 1, and, underneath said lower blade receiving space 74C, a female-side lower mating area, which corresponds to the male-side lower mating area of the male connector 1, are formed between the third terminal retention wall 71C and fourth terminal retention wall 71D. A lower block portion 75B, which downwardly protrudes from the bottom face of the third terminal retention wall 71C in the central area of said female-side lower mating area in the connector-width direction and also extends in the longitudinal direction, a lower guided portion 76B, which comprises a space that penetrates in the longitudinal direction on the outside of said lower block portion 75B in the connector-width direction, and a lower restricted portion 77B, which comprises a space that penetrates in the longitudinal direction on the inside of the said lower block portion 75B in the connector-width direction, are formed in said female-side lower mating area.

While the lower block portion 75B, whose shape approximates turning the upper block portion 75A upside down, has a lower prism portion 75B-1 and a lower supporting portion 75B-2, its shape differs in that the dimensions of the lower prism portion 75B-1 in the connector-width direction are smaller than those of the upper prism portion 75A-1 of the upper block portion 75A. The lower supporting portion 75B-2 stabilizes the position of the fourth blade 20D in the vertical direction by supporting said fourth blade 20D of the male connector 1 from above when the connector is in a mated state.

While the shapes of the lower guided portion 76B and lower restricted portion 77B respectively approximate turning the upper guided portion 76A and upper restricted portion 77A upside down, their shapes differ in that their dimensions in the connector-width direction are larger than those of said upper guided portion 76A and upper restricted portion 77A to the same extent that the lower supporting portion 75B-2, as discussed above, is narrower in width.

Thus, in the present embodiment, the lower block portion 75B, lower guided portion 76B, and lower restricted portion 77B are formed to have connector-width dimensions different from the upper block portion 75A, upper guided portion 76A, and upper restricted portion 77A, which reliably prevents the so-called mis-mating, whereby the female connector 2 is mated with the male connector 1 in an incorrect inverted orientation.

In the present embodiment, the block portions 75A, 75B, guided portions 76A, 76B and restricted portions 77A, 77B are formed within the terminal array range in the connector-width direction, which makes it possible to reduce the dimensions of the female connector 2 in the connector-width direction. Furthermore, due to the fact that the upper block portion 75A, guided portion 76A, and upper restricted portion 77A are positioned so as to mutually overlap within the range of the female-side upper mating area in the vertical direction, and, in addition, the lower block portion 75B, lower guided portion 76B, and lower restricted portion 77B are positioned so as to mutually overlap within the range of the female-side lower mating area in the vertical direction, it is possible to avoid an increase in the dimensions of the housing 70 and, in turn, the female connector 2 in the vertical direction.

The female terminals 80, which are provided in four columns in the vertical direction in correspondence with the blades 20A to 20D of the male connector 1, are secured in place by press-fitting into the respective terminal retention grooves 71A-1 to 71D-1 of the terminal retention walls 71A to 71D from the front. The multiple female terminals 80 of each column include signal terminals and ground terminals. In each column, said signal terminals and said ground terminals are arranged in an order corresponding to the signal terminals and ground terminals of the connector 1. In the present embodiment, for ease of explanation, whenever it is necessary to distinguish the female terminals 80 of each column, said female terminals 80, starting from the upper column, are referred to as the "first female terminals 80A", "second female terminals 80B", "third female terminals 80C", and "fourth female terminals 80D", and the letters "A", "B", "C", and "D" are respectively attached to the reference numeral of each component of the female terminals 80.

The female terminals 80 are fabricated by bending metal strip-like pieces in the through-thickness direction and, as can be seen in FIGS. 3(A) and 3(B), have a resilient arm portion 81, which extends in the longitudinal direction, a retained portion 82, which is a continuation of said resilient arm portion 81 and is secured in place by press-fitting into the front portion of the housing 70, and a connecting portion 83, which is bent so as to extend at a right angle at the rear end of said retained portion 82 (left end in FIGS. 3(A and 3(B)) and is soldered to a corresponding circuit on the circuit board (not shown).

The resilient arm portions 81A to 81D are resiliently deformable in the through-thickness direction (vertical direction in FIGS. 3(A) and 3(B)), and female contact portions 81A-1 to 81D-1 that are resiliently contactable by the male terminals 30A to 30D of the connector 1 are formed by bending in their free end portions. Specifically, as can be seen in FIGS. 3(A) and 3(B), the female contact portions 81A-1, 81B-1 of the resilient arm portions 81A and 81B are formed so as to protrude downwardly, and the female contact portions 81C-1, 81D-1 are formed so as to protrude upwardly. In addition, said resilient arm portions 81A to 81D are positioned such that there is a gap between them and the bottom of the terminal retention grooves 71A-1 to 71D-1 of the terminal retention walls 71A to 71D corresponding thereto, thereby making them resiliently deformable in the vertical direction within the range of the above-mentioned gap when the connector is in a mated state.

As can be seen in FIGS. 3(A) and 3(B), the connecting portions 83A to 83D are positioned forward of the front face of the housing 70 (on the left side in FIGS. 3(A) and 3(B)). The connecting portions 83A, 83B extend upwardly and the connecting portions 83C, 83D extend downwardly.

The mounting members 90, which are intended for fixedly mounting the female connector 2 to the circuit board, are made of sheet metal members and, as can be seen in FIG. 1 and FIG. 2, protrude forward of the front face of the housing 70 and are secured in place by the mounting portions 72A of the side walls 72 of the housing 70.

The thus configured female connector 2 is mounted to the circuit board by disposing it on the mounting surface of the circuit board (not shown), solder-connecting the connecting portions 83A to 83D of the female terminals 80A to 80D to the corresponding circuits of the circuit board and also solder-connecting the mounting members 90 to the corresponding portions of the circuit board.

The operation of mating the male connector 1 with the female connector 2 will be described. First, the male connector 1 and female connector 2 are respectively mounted to the mounting surfaces of the corresponding circuit boards in accordance with the previously described procedures. Then, as can be seen in FIG. 1, FIG. 2, and FIGS. 3(A) and 3(B), the mating portion of the female connector 2 is placed facing the mating portion of the male connector 1 at a location forward of the male connector 1.

Next, as indicated by arrows in FIG. 1, FIG. 2, and FIGS. 3(A) and 3(B), the female connector 2 is moved rearwardly toward the male connector 1 and the mating portion of the female connector 2 is mated with the mating portion of the male connector 1. Specifically, the female connector 2 is first guided toward the standard mating position by introducing the corresponding guiding portions 14A, 14B of the male connector 1 respectively into the guided portions 76A, 76B of the female connector 2 from the back.

In addition, in the process of connector mating, the restricted surfaces of the block portions 75A, 75B of the female connector 2 abut the restricting surfaces (inner lateral surfaces) of the guide portions 14A, 14B of the male connector 1, the restricted surfaces of the guided portions 76A, 76B of the female connector 2 abut the restricting surfaces (outer lateral surfaces) of the guide portions 14A, 14B of the male connector 1, and the restricted surfaces of the restricted portions 77A, 77B of the female connector 2 abut the restricting surfaces of the restricting portions 15A, 15B of the male connector 1, as a result of which the movement of the female connector 2 in the connector-width direction is restricted and it is maintained in the standard mating position.

When connector mating is performed in the standard mating position, the front end section of the arm portion blade 20A-1 of the first blade 20A of the male connector 1 is introduced into the upper blade receiving space 74A of the female connector 2 from the back. In addition, the respective front end sections of the middle partition 18B and the blades 20B, 20C of the male connector 1 are introduced into the middle blade receiving space 74B of the female connector 2 from the back. Furthermore, the front end section of the arm portion blade 20D-1 of the fourth blade 20D is introduced into the lower blade receiving space 74C of the female connector 2.

As a result, the male contact portions 31A-1 to 31D-1 of the male terminals 30A to 30D of the arm portion blades 20A-1 to 20D-1 abut the female contact portions 81A-1 to 81D-1 of the resilient arm portions 81A to 81D of the female terminals 80A to 80D and cause said resilient arm portion 81A to undergo resilient deformation while, at the same time, coming into contact with said female contact portions 81A-1 to 81D-1 under a certain contact pressure and establishing electrical conductivity therewith.

In addition, in the process of connector mating, the block portions 75A, 75B of the female connector 2 are introduced into the block portion receiving spaces 16A, 16B of the male connector 1 from the front. As a result, the upper supporting portion 75A-2 of the upper block portion 75A supports the arm portion blade 20A-1 of the first blade 20A of the male connector 1 from below and, at the same time, the lower supporting portion 75B-2 of the lower block portion 75B supports the arm portion blade 20D-1 of the fourth blade 20D of the male connector 1 from below.

In the connector-mated state, the arm portion blade 20A-1 of the first blade 20A is acted upon by a downwardly directed reaction force originating from the resilient arm portions 81A of the first female terminals 80A that undergo resilient deformation. However, since the upper supporting portion 75A-2 of the upper block portion 75A supports the arm portion blade 20A-1 from below as described above, the downwardly directed movement of said arm portion blade 20A-1 is obstructed. As a result, a stable state of resilient contact between the first male terminals 30A and first female terminals 80A is maintained. In addition, since the upper supporting portion 75A-2 is formed as part of the upper block portion 75A, the above-mentioned reaction force is borne by the upper block portion 75A in its entirety. In this manner, in the present embodiment, the above-mentioned reaction force can be sufficiently counteracted by the upper block portion 75A, which is strong and has large vertical dimensions. For this reason, damage to the housing 10 can be prevented and the state of resilient contact between the first male terminals 30A and first female terminals 80A can also be reliably maintained.

In addition, while the arm portion blade 20D-1 of the fourth blade 20D is similarly acted upon by an upwardly directed reaction force originating from the resilient arm portions 81D of the fourth female terminals 80D, the above-mentioned reaction force is counteracted by the lower block portion 75B, which makes it possible to prevent damage to the housing 10 and also reliably maintain a stable state of resilient contact between the fourth male terminals 30D and the fourth female terminals 80D.

In addition, in the connector-mated state, the arm portion blade 20B-1 of the second blade 20B is acted upon by a downwardly directed reaction force originating from the resilient arm portions 81B of the second female terminals 80B and, at the same time, the arm portion blade 20C-1 of the third blade 20C are acted upon by an upwardly directed reaction force originating from the resilient arm portions 81C of the third female terminals 80C. The arm portion blade 20B-1 of the second blade 20B is supported on the upper face of the middle partition 18B and, on the other hand, the arm portion blade 20C-1 of the third blade 20C is supported on the bottom face of the middle partition 18B. Therefore, since the downwardly directed reaction force borne by the arm portion blade 20B-1 and the upwardly directed reaction force borne by the arm portion blade 20C-1 cancel each other out, the state of resilient contact respectively between the second male terminals 30B and the second female terminals 80B and between the third male terminals 30C and the third female terminals 80C can be reliably maintained.

Although a right-angle electrical connector has been used as the male connector 1 in the present embodiment, the present invention is also applicable to electrical connectors in which a direction orthogonal to the circuit board is used as the direction of connector insertion and extraction.

Although the present embodiment has described an example in which two blade groups are disposed in the connector-width direction in the male connector 1, the number of blade groups is not limited, and it is sufficient to provide at least one blade group. For example, if just one blade group is provided, then the male connector can be configured to have just one unitary mating portion (one mating portion corresponding to a single blade group), in other words, it can be configured as if the male connector 1 of the present embodiment has been divided in two in the connector-width direction. In addition, if three or more blade groups are provided, a configuration can be used in which there is the same number of mating portions as there are blade groups, in other words, it can be shaped as if obtained by coupling, in the connector-width direction, a number of the above-described male connectors resultant from providing a single blade group according to the number of the groups. In addition, in the same manner as the above-described male connector, the female connector can be configured with an increased or reduced number of unitary mating portions.

Furthermore, although the configuration used in the present embodiment has the same number of unitary mating portions in the male connector 1 as in the female connector 2, as an alternative, the number of unitary mating portions in the male and female connectors may be different. For example, if one of the connectors (i.e., either the male connector or the female connector) has three unitary mating portions, then the above-mentioned connector may be mated with three other connectors, each of which has a single unitary mating portion. Alternatively, the above-mentioned connector can be mated with one connector having a single unitary mating portion and one connector having two unitary mating portions. Furthermore, if one connector has multiple unitary mating portions, there is no need to mate the other connector to all of the unitary mating portions, and it is possible to mate the other connector only to some of the unitary mating portions, with the remaining unitary mating portions left unused.

In addition, in response to an increase or decrease in the number of unitary mating portions, the male connector may be provided with guiding portions instead of restricting portions, or with restricting portions instead of guiding portions. At such time, in the female connector, spaces positioned in correspondence with the guiding portions of the male connector are used as guided portions, and spaces positioned in correspondence with the restricting portions of the male connector are used as restricted portions.

Although in the present embodiment, an example of a male connector has been described in which four types of blades of different shapes are provided in the form of layers, the number of blade types is not limited thereto, and it is sufficient to have at least two types, and blades of various types can be provided in the form of layers in the same manner as in the present embodiment.

DESCRIPTION OF THE REFERENCE NUMERALS

Male connector
2 Female connector
10 Housing
14A Upper guiding portion
14B Lower guiding portion
16A Upper block portion receiving space
16B Lower block portion receiving space
17 Holding space
17A First holding groove
17B Second holding groove
17C Third holding groove
17D Fourth holding groove
20A to 20D Blades
20A-1 to 20D-1 Arm portion blades
20A-2 to 20D-2 Leg portion blades
30A to 30D Male terminals (electrically conductive elongated members)
31A to 31D Arm portions
31A-1 to 31D-1 Male contact portions
32A to 32D Curved portions
33A-1 to 33D-1 Connecting portions
70 Housing
80A to 80D Female terminals
75A Upper block portion
75B Lower block portion
76A Upper guided portion
76B Lower guided portion

The invention claimed is:

1. An electrical connector for circuit boards, comprising:

a plurality of blades formed by aligning and securing in place a plurality of electrically conductive elongated members on insulating plates, a housing, comprising holding portions in a front portion of the housing configured to hold the plurality of blades, and a mating portion configured to insert and extract a counterpart connector, wherein a bottom portion of the housing comprises a surface configured to mount to a circuit board, wherein the plurality of electrically conductive elongated members comprises contact portions configured to contact corresponding terminals in the counterpart connector formed at a front end thereof and connecting portions at an opposite end configured to be soldered to corresponding circuits on the circuit board and are formed so as to protrude from the housing, wherein the holding portions formed in the housing have, for each of the plurality of blades, holding grooves that hold a front portion of each of the plurality of blades, and at least one of the plurality of blades is fixedly secured in place within a corresponding holding groove through use of resilient latches positioned at both ends of the at least one of the plurality of blades, while remaining ones of the plurality of blades are made movable through a small gap within the respective corresponding holding grooves, such that upon engagement to the counterpart connector, a portion of the housing provides support for the plurality of blades.

2. The electrical connector for circuit boards according to claim 1, wherein:

the plurality of blades comprise a plurality of types of blades, wherein the length of the plurality of electrically conductive elongated members to be held is different for each type of blade;

wherein the plurality of electrically conductive elongated members comprise arm portions that extend in a direction of insertion and extraction in a rectilinear configuration, and leg portions that are coupled by rear ends of said arm portions and curved portions and extend downwardly toward the bottom, wherein contact portions configured to contact the corresponding terminals of the counterpart connector are formed at front end portions of the arm portions, and the connecting portions soldered to the corresponding circuits of the circuit board formed at the lower ends of the leg portions;

wherein the plurality of types of blades comprises arm portion blades, on which the arm portions are secured in place, and leg portion blades, on which the leg portions are secured in place, with the major surfaces of the arm portion blades and leg portion blades forming an angle and being coupled by the curved portions of the electrically conductive elongated members;

wherein a length of the arm and leg portions of the electrically conductive elongated members of the plurality of blades is configured such that respective arm portion blades and leg portion blades are positioned in a successive manner with intervals provided therebetween; and wherein the holding grooves formed in the housing are formed such that the arm portion blades may be inserted from the back.

3. The electrical connector for circuit boards according to claim 2, wherein the plurality of blades are such that the arm portion blades and leg portion blades are substantially at right angles, and blades other than the blade fixedly secured in place within a holding groove are movable in the direction of insertion and extraction of the counterpart connector.

* * * * *